United States Patent [19]

Beran et al.

[11] Patent Number: 5,036,620

[45] Date of Patent: Aug. 6, 1991

[54] SAFETY ENHANCED PIVOTING DOOR OPERATOR

[75] Inventors: Mark A. Beran; John K. Fortin, both of Niwot, Colo.

[73] Assignee: BC Research & Development, Inc., Niwot, Colo.

[21] Appl. No.: 583,469

[22] Filed: Sep. 17, 1990

[51] Int. Cl.[5] ..... E05B 65/10

[52] U.S. Cl. ..... 49/141; 49/334; 49/337

[58] Field of Search ..... 49/141, 334, 335, 337

[56] References Cited

U.S. PATENT DOCUMENTS

| | | | |
|---|---|---|---|
| 3,039,764 | 6/1962 | Heinsman et al. | 49/141 X |
| 3,300,897 | 1/1967 | Wikkerink | 49/141 X |
| 3,318,047 | 5/1967 | Carson | 49/141 X |
| 3,354,497 | 11/1967 | Armento | 49/141 X |
| 3,470,653 | 10/1969 | Kalog | 49/141 X |
| 3,946,460 | 3/1976 | Johnson | 49/141 X |
| 4,007,557 | 2/1977 | Davis et al. | 49/141 X |
| 4,045,914 | 9/1977 | Catlett | 49/334 |
| 4,110,867 | 9/1978 | Gwozdz | 49/141 X |
| 4,155,199 | 5/1979 | Rubertus | 49/141 |
| 4,472,908 | 9/1984 | Wanzl et al. | 49/141 X |

*Primary Examiner*—Philip C. Kannan
*Attorney, Agent, or Firm*—Harold A. Burdick

[57] ABSTRACT

A safety enhanced pivoting door operator is disclosed which includes an apparatus for selective restraint of the swing door to resist movement of the door in a first direction beyond the fully closed position during routine use while yet allowing movement of the door in the first direction beyond the fully closed position when sufficient force is applied to the door in non-routine situations, for example to allow emergency exit or the like. The operator includes a motor and a drive train connected with a rotatable pivot upon which the door is movable. The apparatus includes a mounting member having a deflectable bar connected therewith. A member for impeding movement of the door beyond the fully closed position is connected with the pivot, the impeding member and the deflectable bar coming into contact during normal use to thus resist movement of the door beyond the closed position, but the bar being deflectable by the impeding member to allow such movement when sufficient non-routine force is applied to the door.

20 Claims, 3 Drawing Sheets

SAFETY ENHANCED PIVOTING DOOR OPERATOR

Field of the Invention

This invention relates to pivoting door operators, and, more particularly, relates to such operators having safety enhancing apparatus for selective door restraint.

Background of the Invention

A variety of mechanisms have been heretofore suggested and/or utilized which accommodate movement of a swing door outwardly for emergency egress (see for example U.S. Pat. Nos. 3,354,497, 4,007,557, and 3,946,460). Additionally, manual release systems to facilitate such movement have also heretofore been suggested and/or utilized (see U.S. Pat. No. 4,110,867). Such release mechanisms have also been suggested for sliding doors (see U.S. Pat. Nos. 3,300,897 and 3,318,047).

The ANSI (Standard For Power Operated Pedestrian Doors (A 156.10, 1985)) code, section 10.3, requires that all inwardly opening doors utilized in public facilities be equipped with emergency "breakout" systems which allow the door to be pushed manually outward past the normally closed position in emergency situations. The maximum force required by the code to move the door beyond the normally closed position is set at 50 pounds when the force is applied one inch from the vertical edge of the door opposite the edge of the door attached to the door pivot.

While such devices as have been heretofore suggested have met with some acceptance, some such devices have proven unduly cumbersome to install and/or operate, have proven not to be entirely reliable in view of the infrequency of use of such devices, their exposure to the open environment, and/or inadequacy of long term lubrication, have required replacement of parts after such an emergency usage, and/or have been unduly expensive to produce. Further improvements could thus still be utilized.

SUMMARY OF THE INVENTION

This invention provides a safety enhanced pivoting door operator which includes an apparatus for selective restraint of a door movable on a rotatable pivot between first and second referents, the door not being intended in routine use to move in a first direction beyond the first referent.

The apparatus includes a mounting member fixable to structure substantially stationary relative to movement of the door, an impeding member connected with the rotatable pivot for movement therewith, and a deflectable member connected with the mounting member at one end and having a second end position to correspond with the position of the door at the first referent for contact with the impeding member when the door is moved in the first direction to the first referent to thus resist movement of the door in the first direction beyond the first referent during routine use. The deflectable member is, however, resiliently deflectable by the impeding member to allow movement of the door in the first direction beyond the first referent when sufficient non-routine force is applied to the door, for example to allow outward movement of the door for emergency egress from a building.

The mounting member, impeding member, and deflectable member are all preferably mounted in a fully enclosed and sealable housing having a portion of the pivot mounted therethrough, thus providing a substantially contaminent-free (dirt, dust, moisture and the like) environment for moving parts and the ability to maintain an oil bath or other suitable lubricating reservoir therein. The deflectable member is preferably a bar connected with the mounting member at one end and having a selectively configured surface at the other end thereof. The impeding member has a selectively configured surface, the surfaces coming into contact at the first referent (corresponding to the fully closed position of the door) with the sufficient non-routine force applied to the door causing a camming of the bar by the impeding member to thus deflect the bar and allow passage of the impeding member beyond the selectively configured surface at the second end thereof.

The apparatus preferably includes a second bar having a different cross-sectional width and thus deflectability connected at one end with the mounting member and having a second end positioned to correspond with the second referent (corresponding for example with the fully open position of the door), the second bar being less deflectable to thereby provide, if desired, for greater or lesser "breakout" force to be applied to the door in order to move the door beyond the fully closed position and/or to provide a fixed stop reference for the door in the fully open position. The mounting member in such configuration is preferably reversible in the housing to thereby reverse the relative positions of the second ends of the two bars.

The door operator overall includes a motor and drive train connected with the housing and with the door pivot for assisting opening and, if desired, closing of the door responsive to the sensed presence of people or objects adjacent to the door.

It is therefore an object of this invention to provide an improved safety enhanced pivoting door operator.

It is another object of this invention to provide an improved apparatus for selective restraint of swing door movement.

It is another object of this invention to provide an apparatus for selective restraint of a door movable on a rotatable pivot between first and second referents, the door not being intended in routine use to move in a first direction beyond the first referent, the apparatus including a mounting member fixable to structure substantially stationary relative to movement of the door, an impeding member connected with the rotatable pivot for movement therewith, and a deflectable member connected with the mounting member at one end and having a second end positioned to correspond to the position of the door at the first referent for contact with the impeding member when the door is moved in the first direction to the first referent to resist movement of the door in the first direction beyond the first referent during routine use, yet being resiliently deflectable by the impeding member to allow movement of the door in the first direction beyond the first referent when sufficient non-routine force is applied to the door.

It is another object of this invention to provide an apparatus for selective restraint of a swing door movable on a rotatable pivot between opened and closed positions, the apparatus including a housing, preferably substantially closable, which is substantially stationary relative to movement of the door, a mounting member fixable adjacent to the pivot to the housing, an impeding member connected with the rotatable pivot for movement therewith and having a selectively configured first surface, and a deflectable bar connected with the mounting member at one end and having a second end positioned to correspond with the closed position of the door, the second end having a selectively configured surface for contact with the first surface of the impeding member when the door is moved in a first direction to the closed position to thus resist movement of the door in the first direction beyond the closed position during routine use, while being resiliently deflectable by the impeding member when sufficient nonroutine force is applied to the door.

It is another object of this invention to provide an apparatus for selective restraint of a swing door which includes a mounting member fixable adjacent to the door pivot to structure substantially stationary relative to movement of the door, an impeding member connected with the rotatable door pivot for movement therewith and having first and second surfaces, and first and second bar members connected with the mounting member, the first bar member being deflectable by the impeding member when sufficient non-routine force is applied to the door, and the second bar member being less deflectable by said impeding members and/or providing a fixed stop for the door in the open position upon contact with the second surface of the impeding member.

It is yet another object of this invention to provide a safety enhanced pivoting door operator including a housing, drive means connected with the housing and the door for causing movement of the door between open and closed positions, a mounting member fixable in the housing adjacent to a rotating portion of the door, an impeding member connected with the rotating portion of the door for movement therewith, and a deflectable bar connected to the mounting member at one end and having a second end positioned to correspond with the closed position of the door.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figures 1, 3:
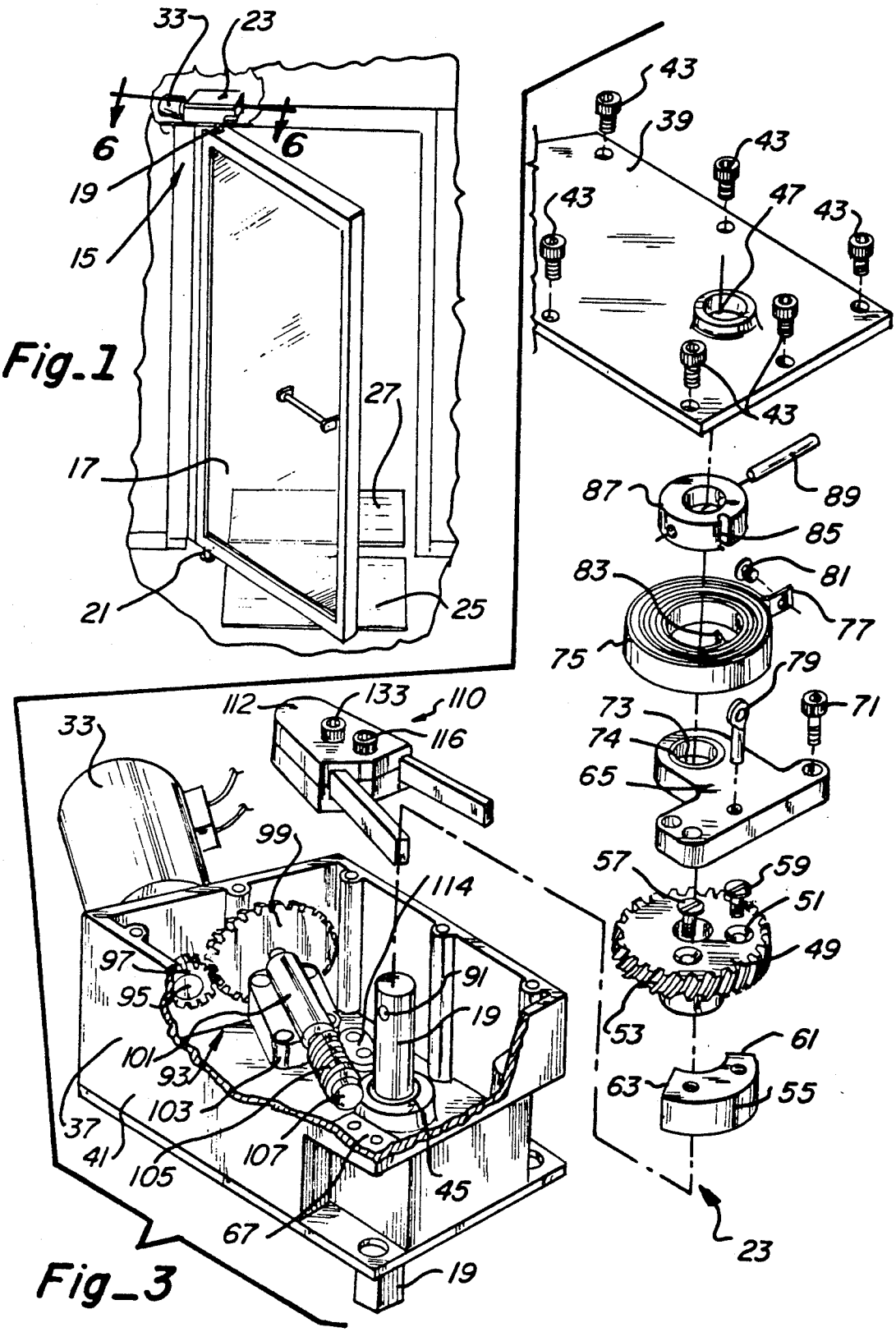
FIG. 1 is a perspective view showing the door operator of this invention in conjunction with a swing door.
FIG. 3 is an exploded perspective view of a portion of the operator shown in FIG. 1.
Figure 2:
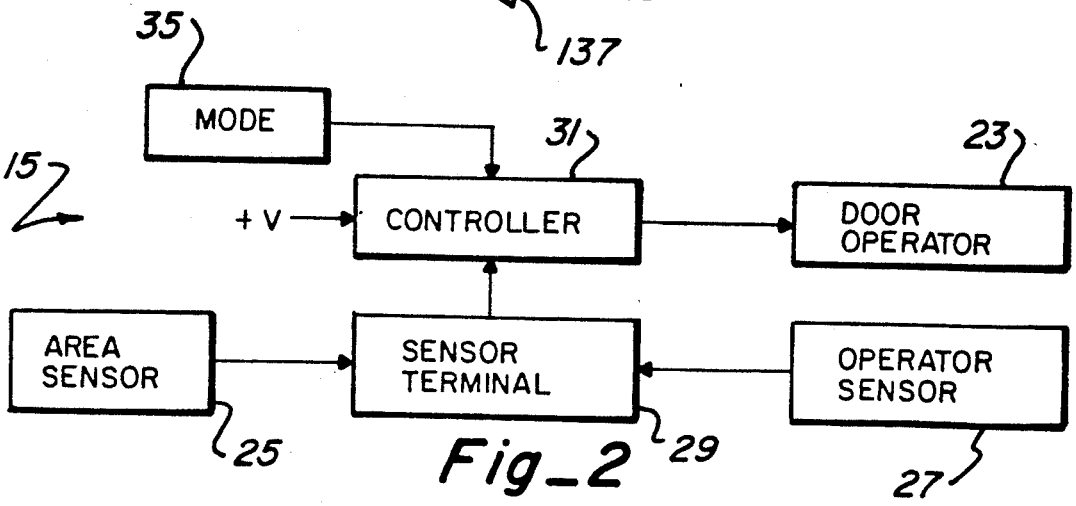
FIG. 2 is a block diagram illustrating the overall makeup of the operator as shown in FIG. 1.

Overall operator system 15 is illustrated in FIGS. 1 and 2 for use in conjunction with swing door 17 movable on rotatable pivots 19 and 21 between first and second referents corresponding, respectively, to fully closed and fully open positions (for example with the closed and open positions representing approximately a 90° scope of movement of the door). The operator system includes door operator 23 connected with upper pivot 19, area sensors 25 and 27 (illustrated herein as pressure sensitive pads, it being understood that any of the variety of known devices for such use could as well be utilized), a sensor terminal 29 and a controller module 31 connected to motor 33 of door operator 23. Optional mode selection switch 35 may also be provided.

In FIGS. 3 through 6, operator 23 is shown in more detail. Housing 37 includes a removable cover portion 39 attachable to body portion 41, for example utilizing screws 43. Upper door shaft 19 is rotatably mounted through opening 45 in housing 37, the opening having a seal and bearing therein. Shaft 19 is in turn mounted at its terminal end at cover 39 at sealable opening 47. The housing is thus fully closable to maintain a clean internal environment and to provide for maintenance of an oil bath therein.

Worm gear 49 is mounted on shaft 19 (for example by compression mounting or utilizing a set screw), worm gear 49 including apertures 51 and 53 therein for mounting thereon of impeding member 55 utilizing screws 57 and 59. Impeding member 55 is an arcuate member having selectively configured surfaces 61 and 63 at opposite ends thereof.

Stabilizing plate 65 is mounted to housing 37 at ledges 67 and 69 utilizing, for example, screws 71. Stabilizing plate 65 includes opening 73 having bearing 74 therein for receipt therethrough of shaft 19. Return assist spring 75 is maintained at end 77 on pin 79 mounted in stabilizing plate 65 utilizing, for example utilizing screw 81, and at end 83 in slot 85 of spring mandrel 87. Mandrel pin 89 maintains spring mandrel 87 on shaft 19 through aperture 91.

Drive train 93 is connected with motor 33 at motor shaft 95 having spiral pinion 97 mounted thereon for engagement with spiral gear 99. Spiral gear 99 is connected for common movement with jack shaft 101 rotatably maintained (for example utilizing spacers and thrust bearings or the like) in housing 37 on block 103. Worm drive 105 is connected to jack shaft 101 and maintained thereon by, for example, castle nut 107. Worm drive 105 in turn engages worm gear 49 to thus drive shaft 19 and thereby door 17, closing being accomplished by either active reverse movement of the shafts, passive closing utilizing spring 75 and/or a combination thereof.

Apparatus 110 for selective restriction of movement of door shaft 19 and thus door 17 is provided and includes impeding member 55, mounting member 112 mounted to housing 37 at surface mount 114 thereof utilizing, for example, screw 116.

Figure 4:
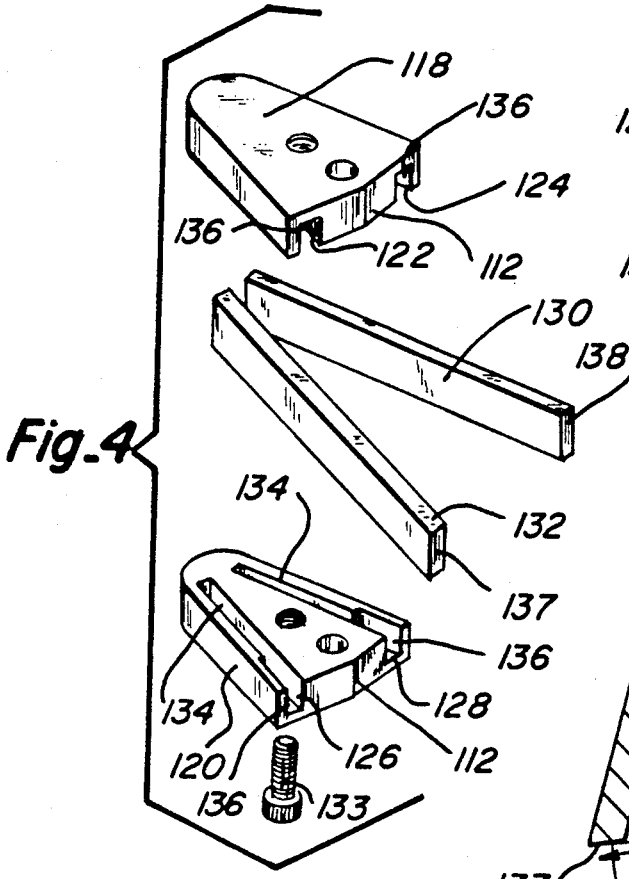
FIG. 4 is an exploded perspective view of a portion of the apparatus for selective restraint of door movement of this invention.
Figure 5:
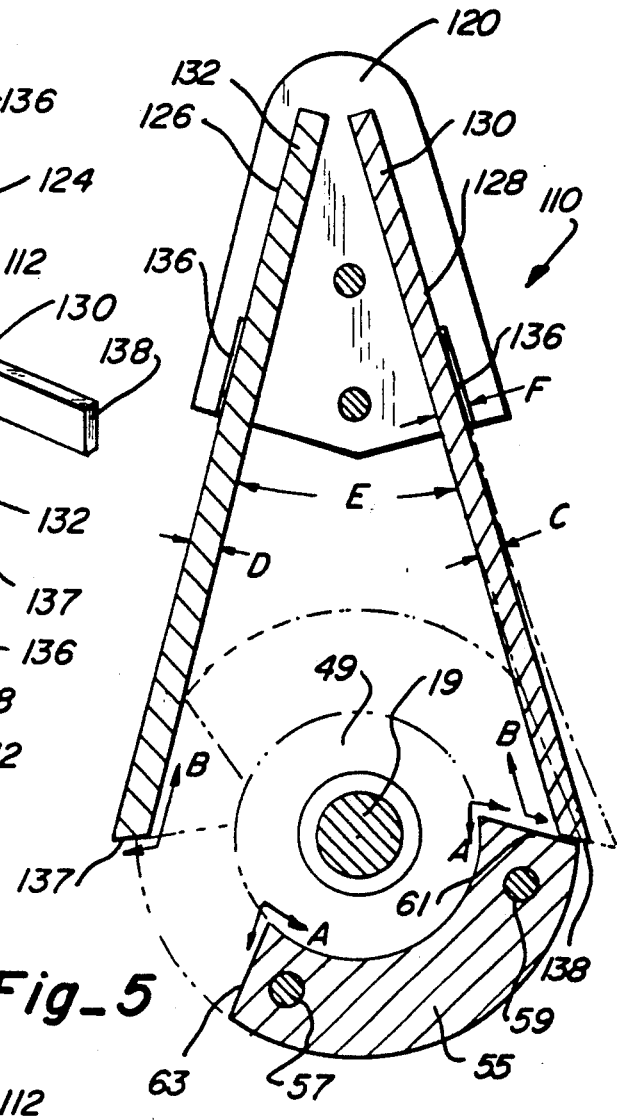
FIG. 5 is a top view of the apparatus for selective restraint of door movement of this invention.
Figure 6:
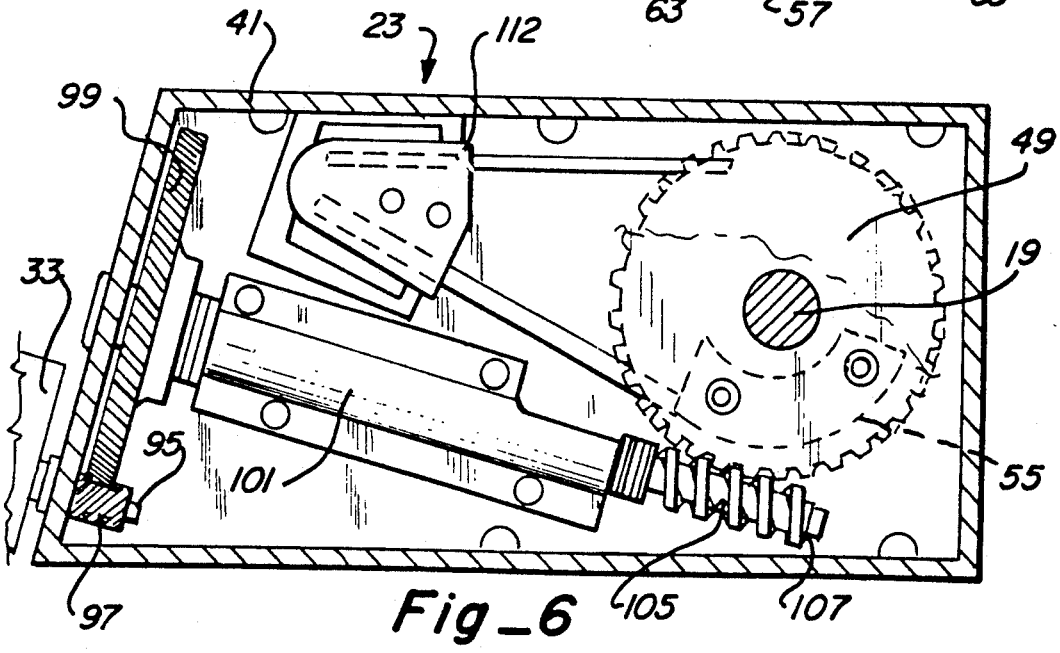
FIG. 6 is a top view of the operator portion illustrated in FIG. 3.

Apparatus 110 is illustrated in greater detail in FIGS. 4 and 5. Mounting member 112 includes upper shell 118 and lower shell 120 each having a pair of slots 122 and 124, and 126 and 128, respectively, therein for receipt of bars 130 (in slots 124/128) and 132 (in slots 122/126).

Figure 7:
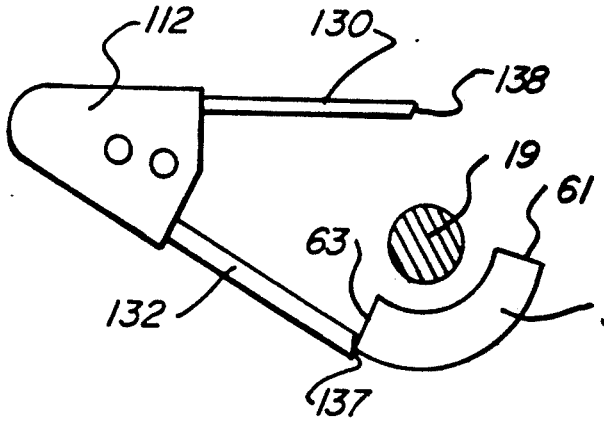
FIGS. 7, 8 and 9 are top views of the restraining apparatus illustrated in FIG. 5 further illustrating the function thereof.
Figure 8:
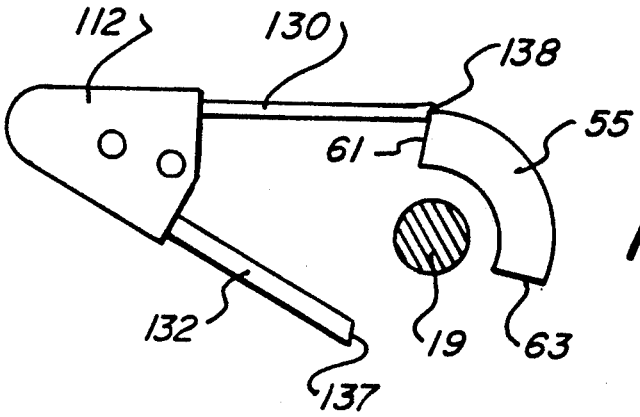
Figure 9:
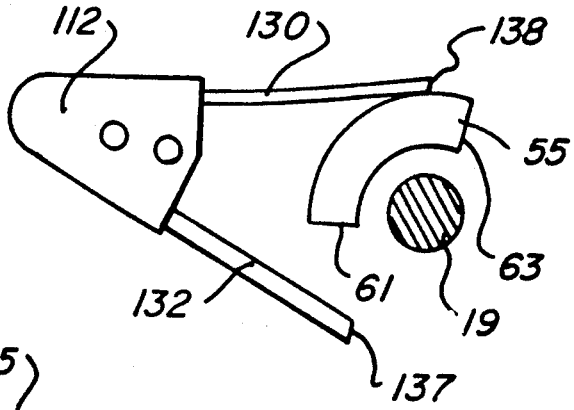

The shells are maintained together utilizing, for example, screw 133. The slots have a width at their inner part 134 substantially corresponding to the width of bars 130 and 132 (bar 132 having a greater cross-sectional width than bar 130) and a width at their outer part 136 greater than the width of the bar received in the slot, with the increase in width being solely at the exterior side of each bar. In this fashion, as further illustrated in FIG. 7 through 9, when impeding member 55 is turned with door shaft 19 to a position corresponding to the fully open position of the door (as shown in FIG. 7), surface 63 of member 55 contacts end 137 of bar 132 (having a thicker cross section) to thus prevent movement of impeding member 55 and thus door 17 beyond the fully open position. When the door is moved to the fully closed position (corresponding to that shown in FIG. 8) surface 61 of member 55 comes into contact with selectively configured surface 138 of bar 130 and, in normal use, resists further movement of the door beyond the fully closed position. However, as shown in FIGS. 5 and 9, when non-routine force, for example as may be the case in an emergency where outward opening of the door is desired, is applied to door 17, impeding member 55 deflects bar 130 by a sliding or camming type interaction between the selectively configured faces 61 and 138 thereby allowing impeding member 55 to be moved beyond bar 130, thus allowing the door to be manually moved beyond the normally fully closed position.

The accommodation of rotation of impeding member 55 past bar 130 is in part due to the selectively configured surfaces, including pressure angles, of impeding member 55 and bar 130 For example, with bars 130 and 132 set at an angle of approximately 29(plus or minus 10°) with respect to one another (see angle E in FIG. 5), acute angles A would preferably be approximately 79° and obtuse angles B of bar 130 would preferably be approximately 101°. The width of fixed stop 132 (shown as dimension D in FIG. 5) would in such case be approximately 0.20 to 0.250 inches, with the width (dimension C in FIG. 5) of deflectable bar 130 being preferably about 0.170 to 0.190 inches. While an angular relationship of surfaces between bar 132 and member 55 is illustrated herein, such a relationship is not necessary.

The angles recited in the foregoing paragraph would be of course varied depending upon the angular placement of the bars with respect to one another, and could be varied for greater or lesser ease of breakout of the door in a range of about plus or minus 2°. It should also be realized that, while movement restricting apparatus 110 is illustrated in conjunction with a power assisted swing door, the apparatus could be adapted for use in association with manually operated swing doors and/or manually operated, spring assisted return swing doors, and that the range of motion of the door between the opened and closed referents could be any desired amount. In addition, while fixed stop bar 132 is shown herein, it should be realized that other types of stops could be utilized for the door and the provision of fixed stop 132 is not entirely necessary in all circumstances (for example where an exterior fix stop is provided and/or where controller 31 controls the range of motion with reference to the fully closed position without the necessity of a fixed stop).

Mounting member 112 may be removed from housing 37 and reoriented therein by rotating member 112 about its axis to reverse the relative positions of bars 130 and 132 to thereby accommodate two discrete force levels necessary and sufficient to move the door beyond its normally fully closed position thus providing for ease of adaptability of the device and a minimum of adjustment or readjustment upon installation. Alternately upper shell 118 could be removed and bars 130 and 132 reversed and turned thus providing the same benefit.

Bars 130 and 132 preferably have a length of between 3 and 3½ inches, with bar 130 deflecting in the range of 0.115 to 0.120 inches. Bars 130 and 132 are preferably made of A2 tool steel, heat treated and drawn back to Rockwell hardness of Rc 54–58. The bars preferably have a height of approximately 178 inch with bar 130 having a moment of inertia of approximately $2.72\times10^{-4}$ inches$^4$ when thus configured. Bar 132 when thus configured would have a moment of inertia of about 4.37 times $10^{-4}$ inches$^4$.The material utilized for bars 130 and 132 preferably has a modulous elasticity of about $30\times10^6$ psi.

Impeding member 55 preferably has an active radius of about 1.30 to 1.350 inches, an outer arc length of the defined arc of about 2.70 to 2.75 inches, and is preferably made of a 1018 case hardened steel having a Rockwell hardness of Rc 54–58. Impeding member 55 has a thickness between the inner and outer circumference of, for example, approximately ¾ inch.

In operation, when sensor 27 detects approaching pedestrians, a check is undertaken at controller 31 for interfering obstacles at sensor 25. If no such obstacle is present, controller 31 activates motor 33 of door operator 23 thus opening the door and holding the door open until traffic clears sensor 25, thereafter closing the door and holding it closed until the next pedestrian approaches. Mode switch 35 allows the door to be continuously held open or closed. If power is somehow lost to the operator, manual operation of door 17 is possible with spring 75 biasing the door to the closed position (working against the essentially shorted brushes of the DC motor) after passage therethrough of a pedestrian.

When the force which drives face 61 of impeding member 55 against surface 138 of deflectable bar 130 is low, bar 130 acts as a fixed stop, thereby providing a reference position for the motor. However, when the force which drives impeding member 55 against bar 130 increases, bar 130 begins to flex and store energy. If force is further increased to a level exceeding the ANSI breakout specifications set forth hereinabove, then impeding member 55 deflects bar 130 further thus moving it out of position and allowing shaft 19 to be rotated beyond its normal fully closed position. Preferably the entire mechanism is located in an oil bath, thus providing reliable and consistent operations even when used very infrequently such as would be the case for such non-routine emergency usages. When the door is pushed back to the fully closed position, controller 31 automatically resets, the end of bar 130 resiliently returns to its previous position, and normal operation can again resume.

What is claimed is:

1. An apparatus for selective restraint of a door movable on a rotatable pivot between first and second referents, the door not being intended in routine use to move in a first direction beyond the first referent, said apparatus comprising:

a mounting member fixable to structure substantially stationary relative to movement of the door;

impeding means connected with the rotatable pivot for movement therewith; and deflectable means connected with said mounting member at one end and having a second end positioned to correspond with the position of the door at the first referent for contact with said impeding means when the door is moved in the first direction to the first referent to resist movement of the door in the first direction beyond the first referent during routine use, yet being resiliently deflectable by said impeding means to allow movement of the door in the first direction beyond the first referent when sufficient non-routine force is applied to the door.

2. The apparatus of claim 1 wherein said deflectable means is a deflectable bar, said second end having a selectively configured surface.

3. The apparatus of claim 2 wherein said selectively configured surface of said bar includes an obtusely angled portion.

4. The apparatus of claim 3 wherein said impeding means includes a selectively configured surface having an acutely angled portion, said surfaces of said deflectable means and said impeding means coming into contact when the door is moved in the first direction to the first referent, and wherein the surface of said impeding means is moved past said surface of said deflectable means when the door is moved in the first direction beyond the first referent upon application of sufficient non-routine force.

5. The apparatus of claim 1 further comprising a fully closable housing configured for maintenance of a lubricant therein, said mounting member, said impeding means and said deflectable means being maintained in said housing.

6. The apparatus of claim 5 wherein said mounting member includes attachment means to maintain said mounting member in said housing to position said second end of said deflectable means in a first position in a first orientation, said mounting member being remountable to said housing means to position said second end of said deflectable member in a second position in a second orientation.

7. The apparatus of claim 1 further comprising stop means connected with said mounting member at one end and having a second end positioned to correspond with the position of the door at the second referent for contact with said impeding means when the door is moved from the first referent to the second referent to thus prevent movement of the door beyond the second referent.

8. An apparatus for selective restraint of a swing door movable on a rotatable pivot between open and closed positions, the door not being intended in routine use to move in a first direction beyond the closed position, said apparatus comprising:

a substantially stationary housing having a portion of the pivot mounted therethrough;

a mounting member fixable adjacent to the pivot to said housing;

impeding means connected with the rotatable pivot for movement therewith and having a selectively configured first surface; and a deflectable bar connected with said mounting member at one end and having a second end positioned to correspond with the closed position of the door, said second end having a selectively configured surface for contact with said first surface of said impeding means when the door is moved in the first direction to the closed position to resist movement of the door in the first direction beyond the closed position during routine use, yet said bar being resiliently deflectable by the contact between said surfaces to allow movement of the door in the first direction beyond the closed position when sufficient non-routine force is applied to the door.

9. The apparatus of claim 8 further comprising a second bar characterized by being less deflectable than said deflectable bar, said second bar being connected with said mounting member at one end and having a second end.

10. The apparatus of claim 9 wherein said impeding means includes a second surface, said second end of said second bar and said second surface of said impeding means coming into contact when the door is moved from the closed position to the open position to thus prevent movement of the door beyond the open position.

11. The apparatus of claim 9 wherein said mounting member includes releasable attaching means for selectively fixing said mounting member to said housing in either one of first and second orientations.

12. The apparatus of claim 8 wherein said mounting member includes a mounting slot for receipt of said one end of said deflectable bar therein, said slot having an inner portion corresponding in width with the width of said bar, and an outer portion having a width greater than the width of said bar.

13. The apparatus of claim 8 wherein said selectively configured first surface of said impeding means includes an acutely angled portion, and wherein said selectively configured surface of said deflectable bar includes an obtusely angled portion.

14. A safety enhanced pivoting door operator comprising:

a housing;

drive means connected with the housing and the door for causing movement of the door between open and closed positions;

a mounting member fixable in the housing adjacent to a rotating portion of the door;

impeding means connected with the rotating portion of the door for movement therewith; and a deflectable bar connected to the mounting member at one end and having a second end positioned to correspond with the closed position of the door for contact with said impeding means when the door is moved from the open to the closed position to thereby resist movement of the door beyond the closed position during routine use, yet being resiliently deflectable by said impeding means to allow said movement of the door beyond the closed position when sufficient non-routine force is applied to the door.

15. The operator of claim 14 further comprising sensing means connected with said drive means for sensing the presence of an object adjacent to the door and providing an output signal indicative thereof.

16. The operator of claim 14 wherein said drive means includes a motor and a drive train having a first part connected with said motor and a second part connected with the rotating portion of the door.

17. The operator of claim 14 wherein the rotatable portion of the door is a rotatable shaft, said impeding means including an arcuate member having a first surface at one end thereof and a second surface at a second end thereof, said first surface of said arcuate member coming into contact with said second end of said deflectable bar, said housing being configured for maintenance of a lubricant therein.

18. The operator of claim 14 further comprising a second bar connected to the mounting member at one end and having a second end positioned to correspond with the open position of the door for contact with the impeding means when the door is moved from the closed to the open position to thereby prevent movement of the door beyond the open position.

19. The operator of claim 18 wherein said second bar is less deflectable than said deflectable bar, said mounting member including releasable attachment means for selective orientation of said mounting member in said housing thereof.

20. The operator of claim 14 wherein said mounting member includes a slot for receipt therein of said one end of said deflectable bar, said slot having an inner portion corresponding in width to the width of said bar and an outer portion having a width greater than the width of said bar.

* * * * *